US007586386B2

(12) United States Patent
Takahashi

(10) Patent No.: US 7,586,386 B2
(45) Date of Patent: Sep. 8, 2009

(54) TRANSMISSION LINE TRANSITION FROM A COPLANAR STRIP LINE TO A CONDUCTOR PAIR USING A SEMI-LOOP SHAPE CONDUCTOR

(75) Inventor: Kouichirou Takahashi, Yokohama (JP)

(73) Assignee: Asahi Glass Company, Limited, Tokyo (JP)

( * ) Notice: Subject to any disclaimer, the term of this patent is extended or adjusted under 35 U.S.C. 154(b) by 139 days.

(21) Appl. No.: 11/374,126

(22) Filed: Mar. 14, 2006

(65) Prior Publication Data

US 2006/0208825 A1 Sep. 21, 2006

(30) Foreign Application Priority Data

Mar. 15, 2005 (JP) ..... 2005-073190

(51) Int. Cl.
*H01P 5/10* (2006.01)

(52) U.S. Cl. ..... 333/26

(58) Field of Classification Search ..... 333/26, 333/33, 246, 1, 238, 156, 262
See application file for complete search history.

(56) References Cited

U.S. PATENT DOCUMENTS 4,211,987 A * 7/1980 Pan ..... 333/230
4,882,553 A * 11/1989 Davies et al. ..... 333/26
5,793,263 A * 8/1998 Pozar ..... 333/26
6,023,210 A * 2/2000 Tulintseff ..... 333/238

FOREIGN PATENT DOCUMENTS

| | | |
|---|---|---|
| JP | 10-163713 | 6/1998 |
| JP | 2004-187258 | 7/2004 |
| JP | 2004-235740 | 8/2004 |
| JP | 2005-73225 | 3/2005 |
| JP | 2005-79789 | 3/2005 |
| JP | 2005-223875 | 8/2005 |

OTHER PUBLICATIONS

K.C. Gupta, et al.. "5.6.2 Microstrip-to-Slotline Cross-Junction Transition", Microstrip Lines and Slotlines, Second Edition, 1996, pp. 305-337, with cover pages.

(Continued)

*Primary Examiner*—Benny Lee
(74) *Attorney, Agent, or Firm*—Oblon, Spivak, McClelland, Maier & Neustadt, P.C.

(57) ABSTRACT

A first dielectric substrate an electromagnetically coupling conductor for a coplanar strip transmission line disposed on a surface close to a dielectric layer, a second dielectric substrate has a grounding conductor disposed on a surface close to the dielectric layer, the grounding conductor has an electromagnetic coupling slot formed in a substantially H-character shape therein, and the second dielectric substrate has an electromagnetically coupling conductor for a microstrip transmission line disposed on a surface remote from the dielectric layer so as to pass over or under the connecting slot.

25 Claims, 8 Drawing Sheets

OTHER PUBLICATIONS

K.C. Gupta, et al., "7.7.5 CPS-to-Slotline Transitions", Microstrip Lines and Slotlines, Second Edition, 1996, pp. 440-441, with endnotes pp. 454-455.

K.C. Gupta, et al., "3.5 Compensated Microstrip Discontinuities", Microstrip Lines and Slotlines, Second Edition, 1996, pp. 204-211, with cover pages.

H.S. Shin, et al., "Wideband and high-gain one-patch microstrip antenna coupled with H-shaped aperture", Electronics Letters, vol. 38, No. 19, Sep. 12, 2002, pp. 1072-1073.

Rainee N. Simons, "Coplanar Striplines", Coplanar Waveguide Circuits, Components, and Systems, 2001, pp. 152-170, with cover pages.

* cited by examiner

Conventional Art

TRANSMISSION LINE TRANSITION FROM A COPLANAR STRIP LINE TO A CONDUCTOR PAIR USING A SEMI-LOOP SHAPE CONDUCTOR

TECHNICAL FIELD OF THE INVENTION

The present invention relates to a transmission line transition, which is suited for a communication system using a microwave or millimeter wave band, and which is capable of making conversion from a microstrip transmission line to a coplanar strip transmission line or from a conductor for a coplanar strip transmission line to a microstrip transmission line.

BACKGROUND OF THE INVENTION

Coplanar strip transmission lines have been generally utilized as transmission lines, which feed a signal to a planar antenna or transmit a signal received by a planar antenna when the planar antenna is utilized for communication using a microwave or millimeter-wave band.

A transmission line transition, which has been utilized to make conversion from a microstrip transmission line to a slot transmission line possible and conversion from the slot transmission line to a coplanar strip transmission line possible, is shown in FIG. 6. In the example shown in FIG. 6, a first dielectric substrate 21 has an electromagnetically coupling conductor 24 for a coplanar strip transmission line disposed in a substantially dew-shaped form thereon, and the first dielectric substrate 21, a dielectric layer 27, a grounding conductor 26 and a second dielectric substrate 22 are laminated in this order. The second dielectric substrate 22 has the grounding conductor 26 disposed on a surface thereof close to the dielectric layer 27, and the grounding conductor 26 has a linear slot 25 formed therein. The second dielectric substrate 22 has an electromagnetically coupling conductor 20 for a microstrip line disposed on a surface thereof remote from the dielectric layer 27. All parts in the example shown in FIG. 6 except for the second dielectric substrate 22 and the electromagnetically coupling conductor 20 for a microstrip line are disclosed in "Microstrip Lines and Slotlines", Second Edition, p. 440-441, 7.7.5 CPS-to-Slotline Transitions, coauthored by K. C. Gupta, Ramesh Garg, Inder Bahl, Prakash Bhartia. However, there has been a problem that a transmission line transition, which partly utilizes the prior art, is not suitable for miniaturization.

Additionally, the above-mentioned prior art reference is silent on specific dimensions of the electromagnetically coupling conductor 24 for a coplanar strip transmission line and the like.

SUMMARY OF THE INVENTION

It is an object of the present invention to solve the above-mentioned problems involved in the prior art and to provide a novel transmission line transition.

The present invention provides a transmission line transition comprising:

a first dielectric substrate;

a second dielectric substrate spaced from the first dielectric substrate;

a dielectric layer interposed between the first dielectric substrate and the second dielectric substrate;

the first dielectric substrate having a pair of conductors for a coplanar strip transmission line and an electromagnetically coupling conductor for the coplanar strip transmission line disposed on a surface close to the dielectric layer;

the electromagnetically coupling conductor for the coplanar strip transmission line being formed in a semi-loop shape with a discontinuity partly formed therein;

respective portions of the electromagnetically coupling conductor for the coplanar strip transmission line, which are located at both ends of the discontinuity or in the vicinity of both ends of the discontinuity, being connected to respective ends of the paired conductors for the coplanar strip transmission line or portions of the paired conductors in the vicinity of the respective ends of the paired conductors, the paired conductors extending toward a direction to be apart from the electromagnetically coupling conductor;

the semi-loop shape being a rectangular shape or a substantially rectangular shape;

the second dielectric substrate having a grounding conductor disposed on a surface close to the dielectric layer, the grounding conductor having a first slot and a second slot formed therein so as to be parallel or substantially parallel to each other;

the grounding conductor further having a connecting slot formed therein so as to connect between the first slot and the second slot so that the first slot, the second slot and the connecting slot form an electromagnetic coupling slot in an H-character shape or substantially H-character shape;

the electromagnetic coupling slot being disposed so that the connecting slot intersects a longitudinal direction of the rectangular shape or the substantially rectangular shape of the semi-loop shape as viewed in a plan view; and the second dielectric substrate having an electromagnetically coupling conductor for a microstrip transmission line disposed on a surface remote from the dielectric layer so as to pass over or under the connecting slot.

The present invention also provides a transmission line transition comprising:

a first dielectric substrate;

a second dielectric substrate spaced from the first dielectric substrate;

a dielectric layer interposed between the first dielectric substrate and the second dielectric substrate;

the first dielectric substrate having a pair of conductors for a coplanar strip transmission line and an electromagnetically coupling conductor for the coplanar strip transmission line disposed on a surface close to the dielectric layer;

the electromagnetically coupling conductor for the coplanar strip transmission line being formed in a semi-loop shape with a discontinuity partly formed therein;

respective portions of the electromagnetically coupling conductor for the coplanar strip transmission line, which are located at both ends of the discontinuity or in the vicinity of both ends of the discontinuity, being connected to respective ends of the paired conductors for the coplanar strip transmission line or portions of the paired conductors in the vicinity of the respective ends of the paired conductors, the paired conductors extending toward a direction to be apart from the electromagnetically coupling conductor;

the semi-loop shape being a square shape or a substantially square shape;

the second dielectric substrate having a grounding conductor disposed on a surface close to the dielectric layer, the grounding conductor having a first slot and a second slot formed therein so as to be parallel or substantially parallel to each other;

the grounding conductor further having a connecting slot formed therein so as to connect between the first slot and the second slot so that the first slot, the second slot and the connecting slot form an electromagnetic coupling slot in an H-character shape or substantially H-character shape;

the electromagnetic coupling slot being disposed so that a portion of the connecting slot extending in a longitudinal direction passes over or under a side of the electromagnetically coupling conductor for the coplanar strip transmission line remote from the discontinuity; and the second dielectric substrate having an electromagnetically coupling conductor for a microstrip transmission line disposed on a surface remote from the dielectric layer so as to pass over or under the connecting slot.

In accordance with the present invention, the electromagnetically coupling conductor for a coplanar strip transmission line is formed in a semi-loop shape with a discontinuity formed therein, and the respective portions of the electromagnetically coupling conductor for the coplanar strip transmission line, which are located at both ends of the discontinuity or in the vicinity of both ends of the discontinuity, are connected to the respective ends of the paired conductors for the coplanar strip transmission line or portions of the paired conductors for the coplanar strip transmission line in the vicinity of the respective ends of the paired conductors. When the semi-loop shape is a rectangular shape or a substantially rectangular shape, the transmission line transition can be made compact by 8.5 to 61% in comparison with the prior art.

When the semi-loop shape is a square shape or a substantially square shape, the transmission line transition can be made compact by 20 to 30% in comparison with the prior art.

The present invention can utilize the above-mentioned structure to realize transmission line conversion and impedance matching between the microstrip transmission line and the coplanar strip transmission line. Additionally, the present invention has an advantage of being capable of fabricating a transmission line transition at a low cost by a simple structure.

When a transmission line transition according to the present invention is utilized as a planar antenna transmission line, which is disposed at the front windshield or the rear windshield of an automobile, it is possible to effectively produce a high frequency antenna. In particular, it is possible to fabricate a high frequency antenna, which is suited for SDARS (Satellite Digital Audio Radio Service for about 2.6 GHz), GPS (Global Positioning System), VICS (Vehicle Information and Communication System), ETC (Electronic Toll Collection System), DSRC (Dedicated Short Range Communication) system and the like.

BRIEF DESCRIPTION OF THE DRAWINGS

For a more complete understanding of the present invention and the advantages thereof, reference is now made to the following description taken in conjunction with the accompanying drawings, wherein like reference numbers represent like parts, and which may not be described in detail for all drawing figures.

DETAILED DESCRIPTION OF THE INVENTION

Figure 1:
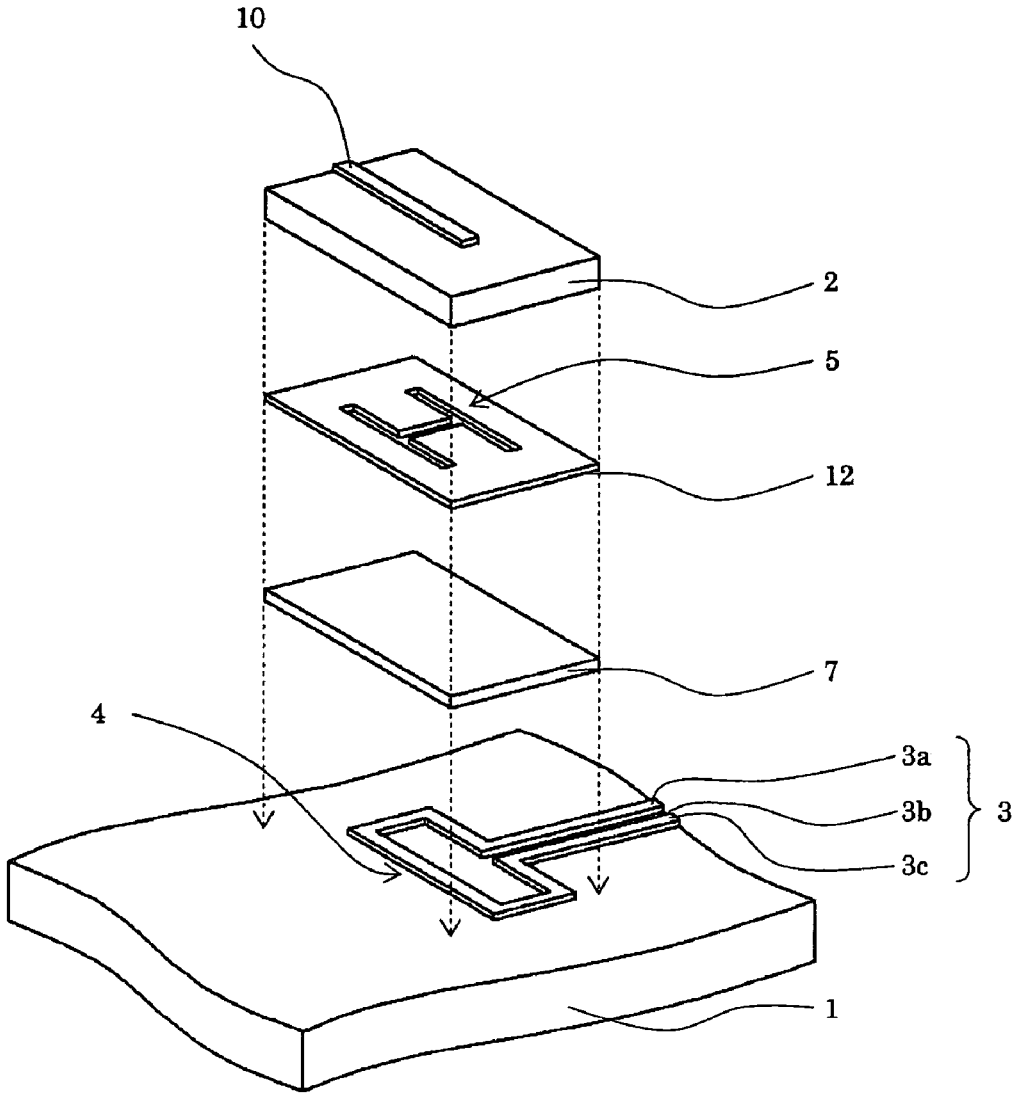
FIG. 1 is a schematic view showing the transmission line transition according to an embodiment of the present invention.

Now, a transmission line transition according to the present invention will be described based on preferred embodiments shown in the accompanying drawings. FIG. 1 is a schematic view showing the transmission line transition according to one embodiment of the present invention, FIG. 2 is a plan view showing an electromagnetic coupling slot 5 and an electromagnetic coupling conductor 10 for a microstrip line in the embodiment shown in FIG. 1, and FIG. 3 is a plan view showing the electromagnetic coupling conductor 10 for the microstrip line and an electromagnetic coupling conductor 4 for a coplanar strip transmission line in the embodiment shown in FIG. 1.

Figure 2:
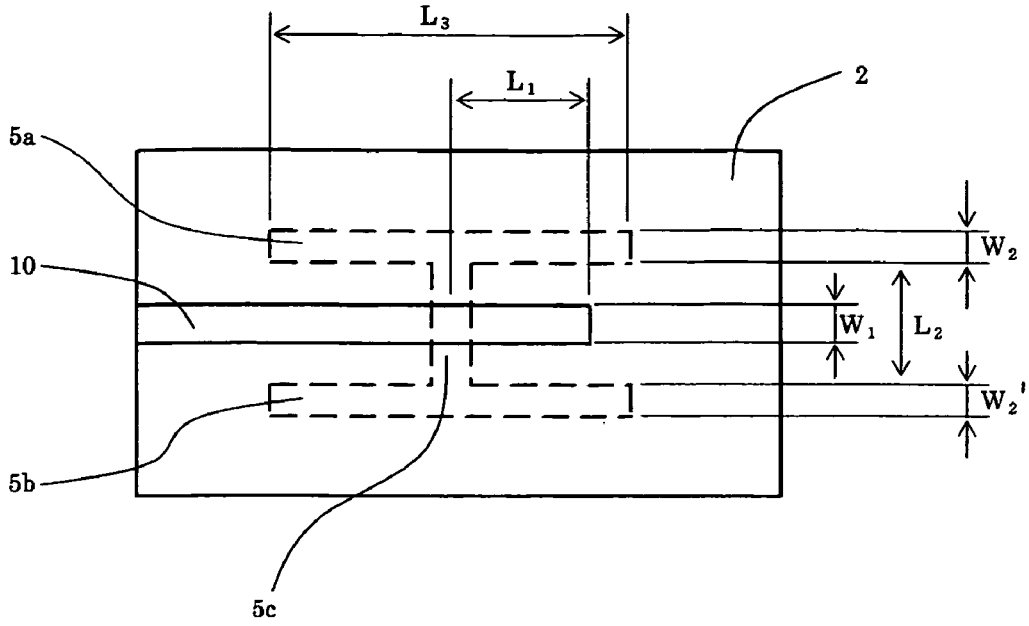
FIG. 2 is a plan view showing an electromagnetic coupling slot and an electromagnetic coupling conductor for a microstrip line in the embodiment.
Figure 3:
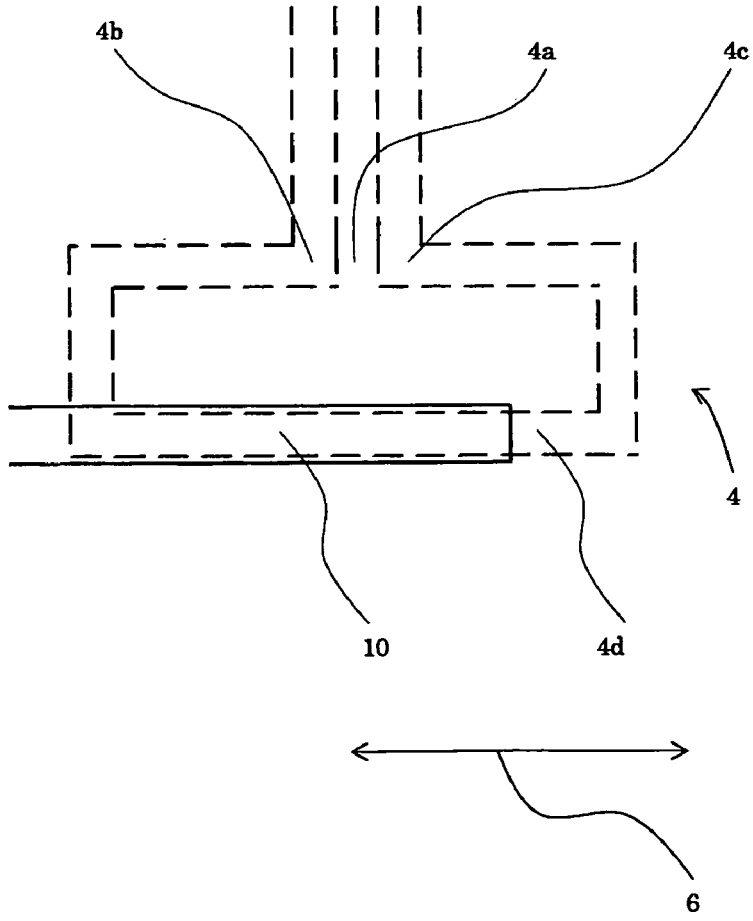
FIG. 3 is a plan view showing the electromagnetic coupling conductor for the microstrip line and an electromagnetic coupling conductor for a coplanar strip transmission line in the embodiment.

In FIGS. 1,2 and 3, reference numeral 1 (FIG. 1) designates a first dielectric substrate, reference numeral 2 (FIGS. 1, 2) designates a second dielectric substrate, reference numeral 3 (FIG. 1) designates a pair of conductors for the coplanar strip transmission line, reference numeral 3*a* (FIG. 1) designates a first conductor for the coplanar strip transmission line, reference numeral 3*b* (FIG. 1) designates a gap for the coplanar strip transmission line, which is disposed between the paired conductors for the coplanar strip transmission line, reference numeral 3*c* (FIG. 1) designates a second conductor for the coplanar strip transmission line, reference numeral 4 (FIGS. 1, 3) designates the electromagnetically coupling conductor for the coplanar strip transmission line, reference numerals 4*b* (FIG. 3) and 4*c* (FIG. 3) designate portions of the electromagnetically coupling conductor for the coplanar strip transmission line, which are located at both ends of a discontinuity 4*a* or in the vicinity of both ends of the discontinuity, reference numeral 4*d* (FIG. 3) designates a side of the electromagnetically coupling conductor for the coplanar strip transmission line, which is remote from the discontinuity, reference numeral 5 (FIG. 1) designates the electromagnetically coupling slot, which is formed in an H-character shape or a substantially H-character shape, reference numeral 5*a* (FIG. 2) designates a first slot, reference numeral 5*b* (FIG. 2) designates a second slot, reference numeral 5*c* (FIG. 2) designates a connecting slot, reference numeral 6 (FIG. 3) designates arrows showing the longitudinal direction of a semi-loop shape of the electromagnetically coupling conductor 4 for the coplanar strip transmission line, reference numeral 7 (FIG. 1) designates a dielectric layer, reference numeral 10 (FIG. 1) designates the electromagnetic coupling conductor for the microstrip line, reference numeral 12 (FIG. 1) designates a grounding conductor, reference $L_1$ (FIG. 2) designates the distance between the center of the connecting slot 5*c* and an open end of the electromagnetic coupling conductor 10 for the microstrip line, reference $L_2$ (FIG. 2) designates the length of the connecting slot 5*c*, reference $L_3$ (FIG. 2) designates the length of the first slot, reference $W_1$ (FIG. 2) designates the conductor width of the electromagnetic coupling conductor 10 for the microstrip line, reference $W_2$ (FIG. 2) designates the width of the first slot 5*a*, and reference $W_2'$, (FIG. 2) designates the width of the second slot 5*b*.

In the embodiment shown in FIG. 1, all parts shown in FIG. 1 are laminated so as to be put one after the other in the direction of arrows.

Figure 4:
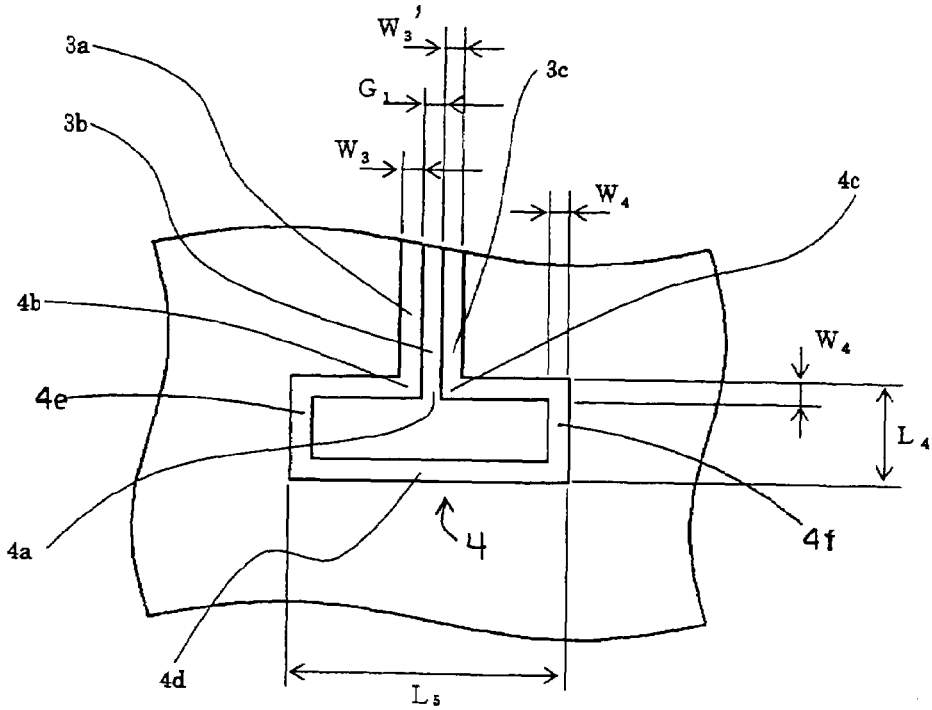
FIG. 4 is a plan view showing the electromagnetic coupling conductor for the coplanar strip transmission line in the embodiment.

FIG. 4 is a plan view of the electromagnetically coupling conductor 4 for the coplanar strip transmission line in the embodiment shown in FIG. 1. In FIG. 4, reference $G_1$ designates the distance between the first conductor 3*a* for the coplanar strip transmission line and the second conductor 3*c* for the coplanar strip transmission line, reference $L_4$ designates the length of a short side of the electromagnetically coupling conductor 4 for the coplanar strip transmission line, reference $L_5$ designates the length of a long side of the electromagnetically coupling conductor 4 for the coplanar strip transmission line, $W_3$ designates the conductor width of the first conductor 3*a* for the coplanar strip transmission line, reference $W_3'$ designates the conductor width of the second conductor 3*c* for the coplanar strip transmission line, and reference $W_4$ designate the conductor width of the electromagnetically coupling conductor 4 for the coplanar strip transmission line. FIG. 4 shows a side 4*e* and a side 4*f* of the electromagnetically coupling conductor 4.

The transmission line transition according to the present invention as best shown in FIG. 1 comprises the first dielectric substrate 1, the second dielectric substrate 2 disposed so as to be spaced from the first dielectric substrate 1, and the dielectric layer 7 disposed between the first dielectric substrate 1 and the second dielectric substrate 2. The first dielectric substrate 1 has the paired conductors 3 for the coplanar strip transmission line and the electromagnetically coupling conductor 4 for the coplanar strip transmission line disposed on a surface thereof close to the dielectric layer 7. The electromagnetically coupling conductor 4 for the coplanar strip transmission line is formed in a semi-loop shape with the discontinuity 4*a* (FIG. 4) formed therein. In the present invention, the semi-loop shape means an incomplete loop shape wherein the loop has a discontinuity partly formed therein.

As best shown in FIG. 4. the portions 4*b* and 4*c* of the electromagnetically coupling conductor 4 for the coplanar strip transmission line, which are located at both ends of the discontinuity 4*a* or in the vicinity of both ends of the discontinuity, are connected to respective ends of the paired conductors 3 of the coplanar strip transmission line or portions of the paired conductors 3 in the vicinity of the respective ends of the paired conductors 3. The paired conductors for the coplanar strip transmission line extend in a direction to be apart from the electromagnetically coupling conductor 4 for the coplanar strip transmission line.

In the present invention, as best shown in FIG. 4, it is preferred from the viewpoint of improving transmission efficiency that the conductor width $W_3$ of the first conductor 3*a* for the coplanar strip transmission line be the same or substantially the same as the conductor width $W_3'$ of the second conductor 3*c* for the coplanar strip transmission line. It is also preferred that the conductor width $W_3$ of the first conductor 3*a* for the coplanar strip transmission line and the conductor width $W_3'$ of the second conductor 3*c* for the coplanar strip transmission line be narrower than the conductor width $W_4$ of the electromagnetically coupling conductor 4 for the coplanar strip transmission line. Further, it is more preferred that the following conditions be satisfied.

$$\text{Conductor width } W_3 \leqq 0.6 \times \text{conductor width } W_4, \text{ and}$$

$$\text{Conductor width } W_3' 0.6 \times \text{conductor width } W_4$$

In the embodiment shown in FIGS. 1 and 3, the semi-loop shape of the electromagnetically coupling conductor 4 for the coplanar strip transmission line is a rectangular shape or a substantially rectangular shape, and the longitudinal direction of the rectangular shape or the substantially rectangular shape intersects the extension direction of portions of the paired conductors 3 for the coplanar strip transmission line, which are located in the vicinity of the discontinuity 4*a*. It is preferred from the viewpoint decreasing insertion loss and improving transmission efficiency that the semi-loop shape be a rectangular shape or a substantially rectangular shape. However, the semi-loop shape is not limited to have a such a shape. Even if the semi-loop shape is a square shape or a substantially square shape, the present invention is operable. It should be noted that the longitudinal direction of the semi-loop shape of the electromagnetically coupling conductor 4 for the coplanar strip transmission line accords (i.e., is in accordance) with the longitudinal direction of the side 4*d* of the electromagnetically coupling conductor 4 for the coplanar strip transmission line, which is remote from the discontinuity.

The second dielectric substrate 2 has the grounding conductor 12 disposed on a surface thereof close to the dielectric layer 7, and the grounding conductor 12 has the first slot 5*a* and the second slot 5*b* formed therein so as to be parallel or substantially parallel to each other. The grounding conductor 12 additionally has the connecting slot 5*c* formed therein to connect the first slot 5*a* and the second slot 5*b*, and the first slot 5*a*, the second slot 5*b* and the connecting slot 5*c* form the electromagnetically coupling slot 5 in an H-character shape or a substantially H-character shape.

In the embodiments shown in FIGS. 8, 9 and 10 stated later, the electromagnetically coupling slot is disposed in such a direction that a portion of the electromagnetically coupling slot overlaps with the electromagnetically coupling conductor 4 for the coplanar strip transmission line as viewed in a plan view and that the connecting slot 5*c* passes over or under a portion of the rectangular or substantially rectangular semi-loop shape extending in the longitudinal direction. The connecting slot 5*c* orthogonally or substantially orthogonally passes over or under the side 4*d* of the electromagnetically coupling conductor 4 for the coplanar strip transmission line, which is remote from the discontinuity.

The second dielectric substrate 2 has the electromagnetically coupling conductor 10 for the microstrip line disposed on a surface remote from the dielectric layer 7 so as to pass over or under the connecting slot 5*c*. In the embodiment shown in FIG. 1, the angle, at which the connecting slot 5*c* and the electromagnetically coupling conductor 10 for the microstrip line intersect each other as viewed a plan view, is a right angle or a substantially right angle. This arrangement is preferred to improve transmission efficiency. However, the present invention is not limited to have this arrangement. The present invention is operable even if the angle formed by the connecting slot 5*c* and the electromagnetically coupling conductor 10 for the microstrip line is not a right angle or a substantially right angle.

When it is assumed that an imaginary straight line extends in a direction perpendicular to the first dielectric substrate 1 and passes through the center of the connecting slot 5*c*, and when the center of the connecting slot 5*c* is viewed from the imaginary straight line, it is preferred from the viewpoint of improving transmission efficiency that the point where the connecting slot 5*c* and the electromagnetically coupling conductor 10 for the microstrip line intersect each other overlap or substantially overlap with the center of the connecting slot 5*c*.

When it is assumed that the imaginary straight line extends in the direction perpendicular to the first dielectric substrate 1 and passes through the center of the connecting slot 5*c*, and when the center of the connecting slot 5*c* is viewed from the imaginary straight line, it is preferred from the viewpoint of improving transmission efficiency that the center of the connecting slot 5*c* overlap or substantially overlap with the side 4*d* of the electromagnetically coupling conductor 4 for the coplanar strip transmission line.

When it is assumed that the imaginary straight line extends in the direction perpendicular to the first dielectric substrate 1 and passes through the center of the connecting slot 5*c*, and when the center of the connecting slot 5*c* is viewed from the imaginary straight line, it is preferred from the viewpoint of improving transmission efficiency that the center of the connecting slot 5*c* overlap or substantially overlap with the center of the side 4*d* of the electromagnetically coupling conductor 4 for the coplanar strip transmission line.

Figure 15:
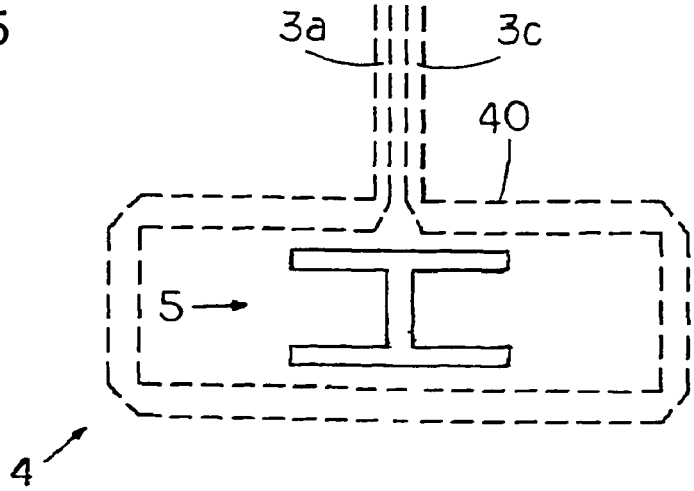
FIG. 15 is a plan view showing an electromagnetic coupling conductor for a microstrip line and an electromagnetic coupling conductor for a coplanar strip transmission line according to another embodiment, which is different from the embodiments shown in FIGS. 8, 9, 10 and 11.

As stated above, it is preferred from the viewpoint of improving transmission efficiency that a portion of the electromagnetically coupling slot 5 overlap with the electromagnetically coupling conductor 4 for the coplanar strip transmission line as viewed in such a plan view. However, the present invention is not limited to have this arrangement. The present invention is operable even if all portions of the electromagnetically coupling slot 5 are disposed inside an inner peripheral edge of the electromagnetically coupling conductor 4 for the coplanar strip transmission line (FIG. 15). FIG. 15 shows an outer edge 40 of a side of the electromagnetically coupling conductor 4 close to the first conductor 3*a* and the second conductor 3*c*.

In the embodiment shown in FIGS. 1 and 4, in a case wherein the electromagnetically coupling conductor 4 for the coplanar strip transmission line has a certain conductor width, when it is assumed that the electromagnetically coupling conductor 4 for the coplanar strip transmission line has no discontinuity 4*a* formed therein, and that the electromagnetically coupling conductor 4 for the coplanar strip transmission line is disposed so as to be continuous at the portion with the shown discontinuity 4*a*; the electromagnetically coupling conductor 4 for the coplanar strip transmission line thus assumed has an outer peripheral edge and an inner peripheral edge formed in a square or substantially square shape, respectively.

Figure 7:
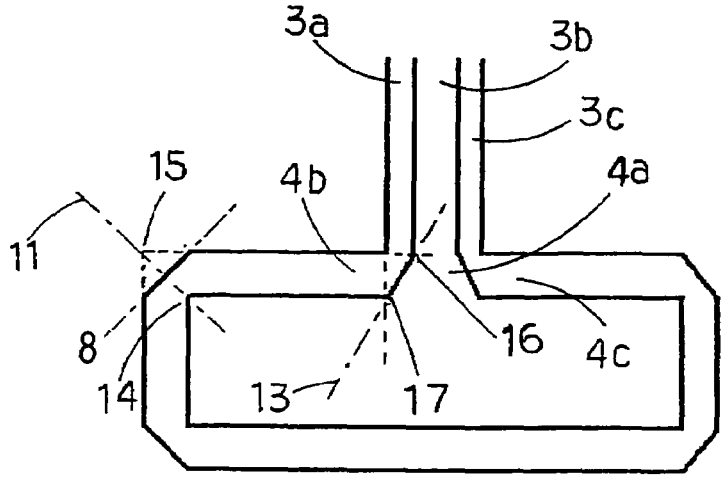
FIG. 7 is a plan view showing an electromagnetic coupling conductor for a coplanar strip transmission line, according to another embodiment, which is different from the embodiment shown in FIGS. 1 and 4.

The electromagnetically coupling conductor 4 for the coplanar strip transmission line according another embodiment, which is different from the embodiment shown in FIGS. 1 and 4, is shown in FIG. 7. In the embodiment shown in FIG. 7, in a case wherein the respective four apexes of the four corners of the square shape or the substantially square shape defined by the outer peripheral edge of the electromagnetically coupling conductor 4 for the coplanar strip transmission line are called outer peripheral apexes, wherein the respective four apexes of the four corners of the square shape or the substantially square shape defined by the inner peripheral edge of the electromagnetically coupling conductor for the coplanar strip transmission line are called inner peripheral apexes, and wherein explanation is made about an outer peripheral apex 15 as an example, which is located at an upper left position in FIG. 7; when it is assumed that a first imaginary straight line connects between the outer peripheral apex 15 and an inner peripheral apex 14 closest to the outer peripheral apex 15, when the first imaginary straight line is called a first imaginary line 11, when it is assumed that a second imaginary straight line extends orthogonally or substantially orthogonally to the first imaginary line 11 and passes through the center or a position in the vicinity of the center between the outer peripheral apex 15 and the inner peripheral apex 14, and when the second imaginary straight line is called a second imaginary line 8, a portion of the electromagnetically coupling conductor 4 for the coplanar strip transmission line, which is located outside the second imaginary line, is cut out, forming a cut-out portion.

It is preferred that each of all four outer peripheral apexes have a cut-out portion formed therein as in the embodiment shown in FIG. 7. However, the present invention is not limited to have this arrangement. The present invention is operable as long as at least one of the four outer peripheral apexes has a cut-out portion.

In the embodiment shown in FIG. 7, when it is assumed that an outer peripheral edge of the portion 4*b* of the electromagnetically coupling conductor 4 for the coplanar strip transmission line, which is close to the first conductor 3*a* for the coplanar strip transmission line and forms one of both end portions of the electromagnetically coupling conductor 4 for the coplanar strip transmission line at both ends of the discontinuity 4*a*, is linearly extended toward a central portion of the discontinuity, when a point where the extended outer peripheral edge intersects an inner peripheral edge of the first conductor 3*a* for the coplanar strip transmission line is called a first intersection 16, when it is assumed that an outer peripheral edge of the first conductor 3*a* for the coplanar strip transmission line is linearly extended toward the central portion of the electromagnetically coupling conductor 4 for the coplanar strip transmission line, and that a point where the extended outer peripheral edge of the first conductor intersects the inner peripheral edge of the electromagnetically coupling conductor 4 for the coplanar strip transmission line is called a second intersection 17, when it is assumed that a third imaginary straight line connects between the first intersection 16 and the second intersection 17, and when the imaginary straight line is called a third imaginary line 13; a portion of the electromagnetically coupling conductor 4 for the coplanar strip transmission line or the first conductor 3*a* for the coplanar strip transmission line, which is closer to the central portion of the electromagnetically coupling conductor 4 for the coplanar strip transmission line than the third imaginary straight line, is cut out, forming a cut-out portion (a first inner cut-out portion).

The outer peripheral edge of the first conductor 3*a* for the coplanar strip transmission line means a peripheral edge of the first conductor 3*a* for the coplanar strip transmission line, which is remote from the gap 3*b* for the coplanar strip transmission line. The inner peripheral edge of the first conductor 3*a* for the coplanar strip transmission line means a peripheral edge of the first conductor 3*a* for the coplanar strip transmission line, which is close to the gap 3*b* for the coplanar strip transmission line.

Additionally, in the embodiment shown in FIG. 7, when it is assumed that an outer peripheral edge of the portion 4*c* of the electromagnetically coupling conductor for the coplanar strip transmission line, which is close to the second conductor 3*c* for the coplanar strip transmission line and forms the other one of both end portions of the electromagnetically coupling conductor for the coplanar strip transmission line at both ends of the discontinuity 4*a*, is linearly extended toward the central portion of the discontinuity, when the point where the extended outer peripheral edge intersects an inner peripheral edge of the second conductor 3*c* for the coplanar strip transmission line is called a third intersection, when it is assumed that an outer peripheral edge of the second conductor 3*b* for the coplanar strip transmission line is linearly extended toward the central portion of the electromagnetically coupling conductor 4 for the coplanar strip transmission line, and that the point where the extended outer peripheral edge of the second conductor intersects the inner peripheral edge of the electromagnetically coupling conductor 4 for the coplanar strip transmission line is called a fourth intersection, when it is assumed that a fourth imaginary straight line connects between the third intersection and the fourth intersection, and when the fourth imaginary straight line is called a fourth imaginary line; a portion of the electromagnetically coupling conductor 4 for the coplanar strip transmission line or the second conductor for the coplanar strip transmission line, which is closer to the central portion of the electromagnetically coupling conductor 4 for the coplanar strip transmission line than the fourth imaginary straight line, is cut out, forming a cut-out portion (a second inner cut-out portion).

It is preferred that the electromagnetically coupling conductor 4 for the coplanar strip transmission line have both the first inner cut-out portion and the second inner cut-out portion formed therein as shown in FIG. 7. However, the present invention is not limited to have this arrangement. The present invention is operable even if the electromagnetically coupling conductor 4 for the coplanar strip transmission line has only one of the first inner cut-out portion and the second inner cut-out portion formed therein.

When the electromagnetically coupling conductor 4 for the coplanar strip transmission line has a short side length of $L_4$, and when the electromagnetically coupling conductor for the coplanar strip transmission line has a long side length $L_5$, it is preferred from the viewpoint of improving transmission efficiency that the formula of $0.11 \leqq (L_4/L_5) < 1.0$, in particular $0.11 \leqq (L_4/L_5) < 0.65$, be satisfied.

It is preferred from the viewpoint of improving transmission efficiency that the length $L_3$ of the first slot and the length of the second slot be the same or substantially the same as each other. However, the present invention is not limited to have this arrangement. The present invention is operable even if the length $L_3$ of the first slot and the length of the second slot are different from each other. It is preferred from the viewpoint of improving transmission efficiency that the length $L_3$ of the first slot of the length of the second slot be normally shorter than the length $L_5$.

It is preferred from the viewpoint of improving transmission efficiency that the width $W_2$ of the first slot 5*a* and the width $W_2'$ of the second slot 5*b* be from 0.1 to 1.0 mm, in particular from 0.2 to 0.6 mm. It is preferred from the viewpoint of improving transmission efficiency that the conductor width $W_1$ of the electromagnetically coupling conductor 10 of the microstrip line be from 1.0 to 2.0 mm, in particular from 1.3 to 1.6 mm. It is preferred from the viewpoint of improving transmission efficiency that the distance $L_1$ be from 3.0 to 15.0 mm, in particular from 5.0 to 10.0 mm.

In the present invention, when the operating frequency is from 1.95 to 2.93 GHz, it is preferred that the length $L_5$ of the side of the electromagnetically coupling conductor 4 for the coplanar strip transmission line, which is remote from the discontinuity 4*a*, be from 5.0 to 46.1 mm. The reason why the operating frequency is set at a value from 1.95 to 2.93 GHz is that the formula of (2.34/1.2)−(2.34/0.8) GHz≈1.95−2.93 GHz is established, providing a tolerance range of 20% from 2.34 GHz that is the frequency of SDARS in the United States. The permissible range is preferably from 2.13 to 2.6 GHz with a tolerance range of 10%, more preferably from 2.23 to 2.46 GHz with a tolerance range of 5%.

The length $L_5$ preferably ranges from 8.0 to 40.8 mm, more preferably ranges from 12.0 to 37.2 mm.

Under the condition of the above-mentioned operating frequency range, it is preferred that the length $L_4$ of two sides of the electromagnetically coupling conductor 4 for the coplanar strip transmission line, which are adjacent the side 4*d* opposite the discontinuity 4*a*, be from 5.0 to 46.1 mm. The length $L_4$ more preferably ranges from 8.0 to 40.8 mm, most preferably ranges from 12.0 to 37.2 mm.

Figure 8:
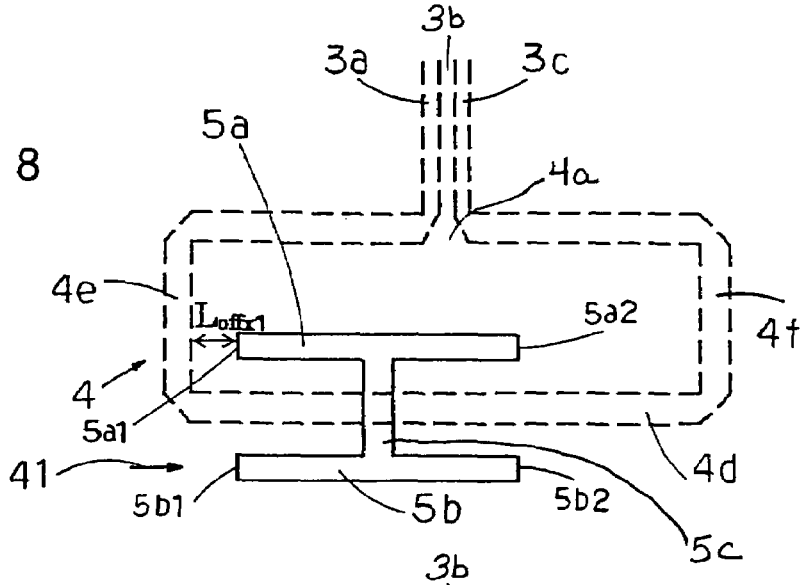
FIG. 8 is a plan view for explanation of $L_{offx1}$.
Figure 9:
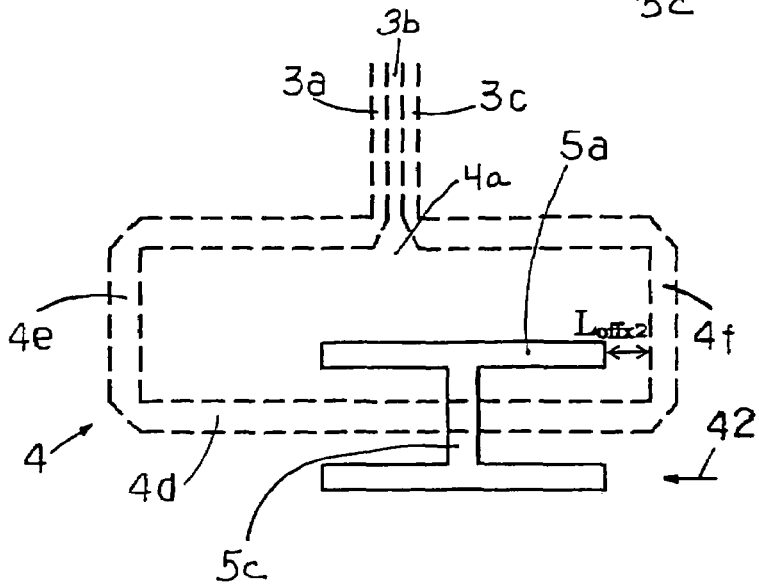
FIG. 9 is a plan view for explanation of $L_{offx2}$.

FIGS. 8 and 9 are plan views for explanation of $L_{offx1}$ and $L_{offx2}$ described later. Explanation of the following conditions will be made when it is assumed that an imaginary straight line passes through the center of the gap 3*b* for the coplanar strip transmission line and extends toward the center of the electromagnetically coupling conductor 4 for the coplanar strip transmission line under the condition of the above-mentioned operating frequency range, and wherein the electromagnetically coupling conductor 4 for the coplanar strip transmission line is viewed, being divided into a portion close to the first conductor 3*a* for the coplanar strip transmission line and a portion close to the second conductor 3*c* for the coplanar strip transmission line with this imaginary straight line used as the boundary.

The inner edge of a side 4*e* of the electromagnetically coupling conductor 4 for the coplanar strip transmission line, which forms one of the two sides adjacent the side 4*d* opposite the discontinuity 4*a* and is close to the first conductor 3*a* for the coplanar strip transmission line, is called a first inner edge. The inner edge of a side 4*f* of the electromagnetically coupling conductor 4 for the coplanar strip transmission line, which forms the other one of the two sides adjacent the side 4*d* opposite the discontinuity 4*a* and is close to the second conductor 3*c* for the coplanar strip transmission line, is called a second inner edge.

When the leading edge of the first slot 5*a*, which is close to the first inner edge, is called a first leading edge 5*a*1 (FIG. 8) of the first slot; when the leading edge of the first slot 5*a*, which is close to the second inner edge, is called a second leading edge 5*a*2 (FIG. 8) of the first slot; when the leading edge of the second slot 5*b*, which is close to the first inner edge, is called a first leading edge 5*b*1 of the second slot; when the leading edge of the second slot 5*b*, which is close to the second inner edge, is called a second leading edge 5*b*2 of the second slot; when a shorter one of the shortest distance between the first leading edge 5*a*1 of the first slot and the first inner edge, and the shortest distance between the first leading edge 5*b*1 of the second slot and the first inner edge is called $L_{offx1}$ (FIG. 8); and when a shorter one of the shortest distance between the second leading edge 5*a*2 of the first slot and the second inner edge, and the shortest distance between the second leading edge 5*b*2 of the second slot and the second inner edge is called $L_{offx2}$ (FIG. 9); it is preferred that the formulas of $L_{offx1} \geqq -2$ mm and $L_{offx2} \geqq -2$ mm are satisfied, where $L_{offx1}$ is negative when the closer of the first leading edge 5*a*1 and the first leading edge 5*b*1 to the first inner edge is disposed beyond the first inner edge relative to the side 4*f*, and $L_{offx2}$ is negative when the closer of the second leading edge 5a2 and the second leading edge 5b2 to the second inner edge is disposed beyond the second inner edge relative to the side 4e.

It is determined that the value of $L_{offx1}$ is positive when the first leading edge 5a1 of the first slot approaches toward the center of the electromagnetically coupling conductor 4 for the coplanar strip transmission line in a direction (indicated by an arrow 41 in FIG. 8), which is parallel to the longitudinal direction of the side 4d of the electromagnetically coupling conductor 4 for the coplanar strip transmission line remote from the discontinuity 4a, and that the value of $L_{offx1}$ is negative when the first leading edge 5a1 of the first slot recedes from the center in such a direction.

It is determined that the value of $L_{offx2}$ is positive when the second leading edge 5a2 of the first slot approaches toward the center of the electromagnetically coupling conductor 4 for the coplanar strip transmission line in a direction (indicated by an arrow 42 in FIG. 9), which is parallel to the longitudinal direction of the side 4d of the electromagnetically coupling conductor 4 for the coplanar strip transmission line remote from the discontinuity 4a, and that the value of $L_{offx2}$ is negative when the second leading edge 5a2 of the first slot recedes from the center in such a direction.

It is preferred that the values of $L_{offx1}$ and $L_{offx2}$ satisfy the formulas of $L_{offx1} \geqq 0$ mm and $L_{offx2} \geqq 0$ mm. It is particularly preferred that the values of $L_{offx1}$ and $L_{offx2}$ satisfy the formulas of $L_{offx1} \geqq 1$ mm and $L_{offx2} \geqq 1$ mm.

Figure 10:
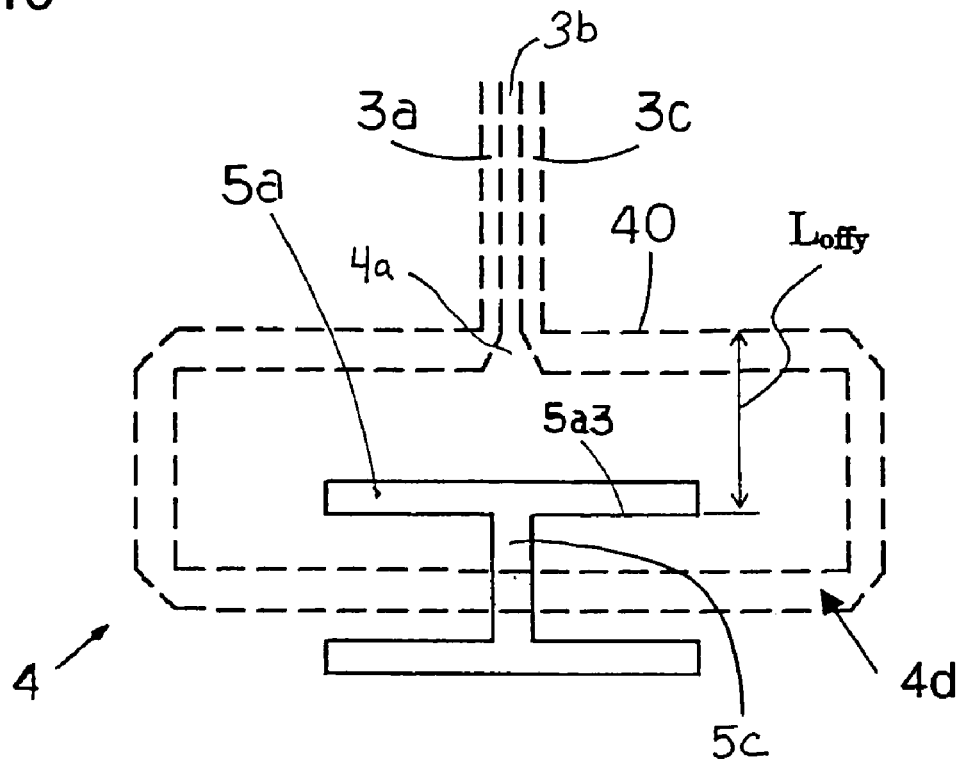
FIG. 10 is a plan view for explanation of $L_{offy}$ wherein the value of $L_{offy}$ is positive.
Figure 11:
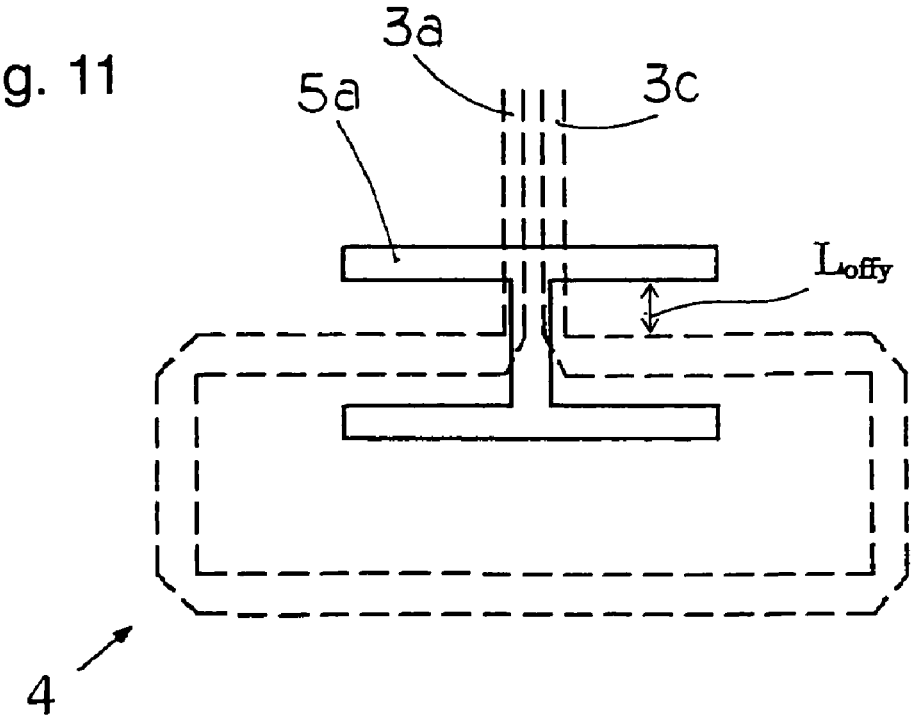
FIG. 11 is a plan view for explanation of $L_{offy}$ wherein the value of $L_{offy}$ is negative.

FIGS. 10 and 11 are plan views for explanation of $L_{offy}$ described later. In FIGS. 10 and 11, when the distance between an outer edge 40 (FIG. 10) of a side of the electromagnetically coupling conductor 4 for the coplanar strip transmission line close to the paired conductors 3a, 3c for the coplanar strip transmission line and an edge 5a3 (FIG. 10) of the first slot close to the connecting slot 5c is called $L_{offy}$, it is preferred that the formula of $-4.3$ mm$\leqq L_{offy} \leqq 8.0$ mm is satisfied, where $L_{offy}$ is negative when edge $\mathbf{5}_a\mathbf{3}$ is disposed beyond the outer edge 40 relative to side 4d.

It is determined that the value of $L_{offy}$ is positive when the edge 5a3 of the first slot close to the connecting slot 4c is disposed so as to be close to the side 4d of the electromagnetically coupling conductor 4 for the coplanar strip transmission line remote from the discontinuity 4a with the outer edge 40 of the side of the electromagnetically coupling conductor 4 for the coplanar strip transmission line close to the paired conductors (3a, 3c) for the coplanar strip transmission line used as the boundary (FIG. 10), and that the value of $L_{offy}$ is negative when the edge 5a3 of the first slot is disposed beyond the outer edge 40 relative to side 4d and so as to be close to the paired conductors (3a, 3c) for the coplanar strip transmission line (FIG. 11).

The value of $L_{offy}$ preferably satisfies the formula of $-3.5$ mm$\leqq L_{offy} \leqq 7.3$ mm, particularly preferably satisfies the formula of 1.0 mm$\leqq L_{offy} \leqq 6.5$ mm.

There is no particular limitation to the thickness of the first dielectric substrate 1 since the thickness of the first dielectric substrate is not directly related to electromagnetic coupling. For example, when the first dielectric substrate comprises an automobile windshield, it is preferred to use a glass sheet having a thickness of from 2.0 to 6.0 mm and a dielectric constant of ($\epsilon_1$) of from 5.0 to 9.0 as in a normal automobile windshield.

When the first dielectric substrate 1 comprises an automobile windshield, it is preferred that the grounding conductor 12 have a peripheral edge spaced from the opening edge of an automobile body by a length of 1 mm or more. However, the present invention is not limited to have this arrangement. The present invention is operable even if the peripheral edge of the grounding conductor 12 is connected to the opening edge of an automobile body. In this case, the opening edge means a peripheral edge of an opening of an automobile body, into which a windshield is fitted, which serves as ground connection through the automobile body, and which is made of a conductive material, such as metal.

It is preferred that the second dielectric substrate 2 have dimensions (an area) of from 2.6×26.0 mm (67.6 $mm^2$) to 15.0×31.0 mm (465 $mm^2$). It is preferred from the viewpoint of improving transmission efficiency that the second dielectric substrate have a dielectric constant ($\epsilon_2$) of from 1.0 to 8.0. The second dielectric substrate 2 may be normally a circuit board comprising a synthetic resin, ceramics or the like. It is preferred that the second dielectric substrate 2 have a thickness of from 0.1 to 6.0 mm. This is because it is easy to fabricate a substrate in such a thickness range in terms of production technique.

It is preferred that the dielectric layer 7 be interposed between the first dielectric substrate 1 and the second dielectric substrate 2 and have an insulating property. The dielectric layer 7 may normally comprise a dielectric composition containing, e.g., a synthetic resin, such as an adhesive or a filler, having an insulating property, or ceramics. The dielectric layer may comprise a gas layer. However, the present invention is not limited to have such arrangements. Any dielectric substance is applicable as the dielectric layer, and a dielectric substrate is also applicable as the dielectric layer.

An example of the adhesive having an insulating property is an adhesive containing an epoxy resin or the like. It is preferred to use an adhesive having a dielectric constant ranging from 1.0 to 4.0 since such an adhesive is easily available at a low cost. An example of the filler is a filler containing silicone having an insulating property.

When the dielectric layer 7 comprises a gas layer, an air layer is normally used because of being inexpensive. The present invention is not limited to use such an air layer. The gas layer may comprise an inert gas, such as nitrogen or argon. It is preferred that such a gas layer be sufficiently dried so as to prevent the moisture contained in the gas from being condensed according to temperatures.

It is preferred that the dimensions or area of the dielectric layer 7 be the same as the dimensions or area of the second dielectric substrate 2. It is preferred from the viewpoints of improving transmission efficiency that the dielectric layer 7 have a thickness of from 0.1 to 1.6 mm. It is preferred from the viewpoint of improving transmission efficiency that the dielectric layer 7 have a dielectric constant ($\epsilon_3$) of from 1.0 to 3.0. It is preferred that the present invention be applied to a frequency range of from 1 to 30 GHz, in particular a frequency range from 2 to 6 GHz.

EXAMPLE

Now, the present invention will be described referring to examples. The present invention is not limited to these examples. It should be noted that various improvement and modifications may be made without departing from the spirit and the scope of the present invention. Now, the examples will be described in detail, referring to the accompanying drawings.

Example 1

Figure 5:
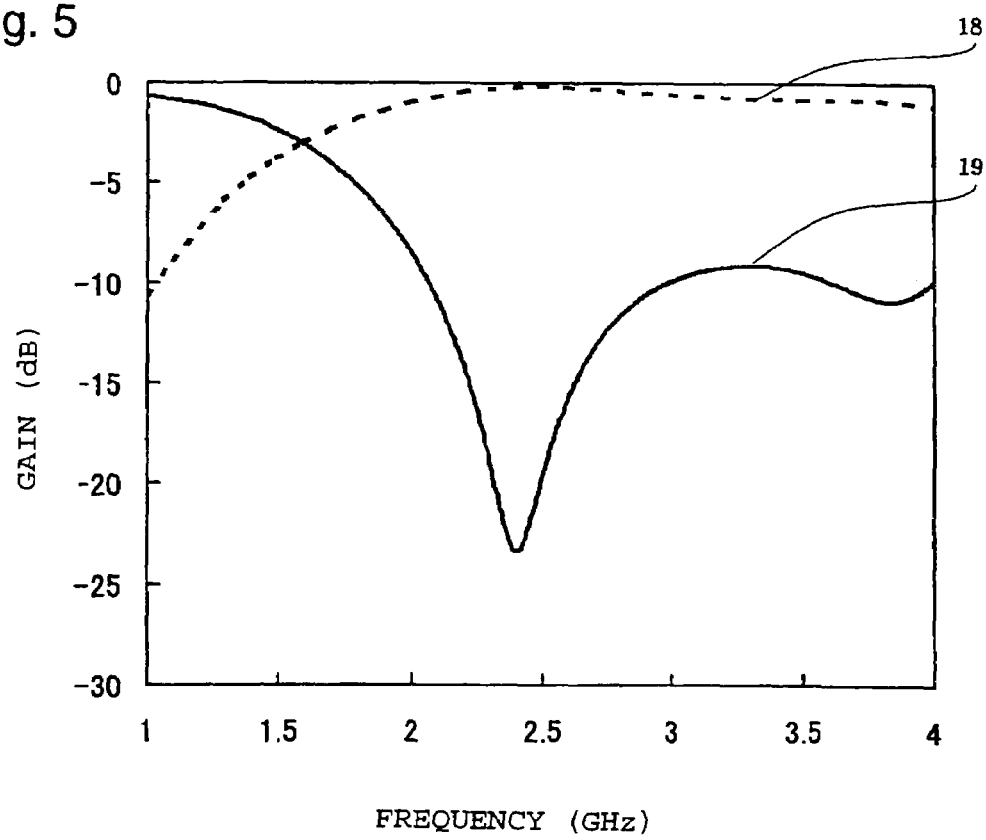
FIG. 5 is a frequency characteristic graph in an Example.
Figure 6:
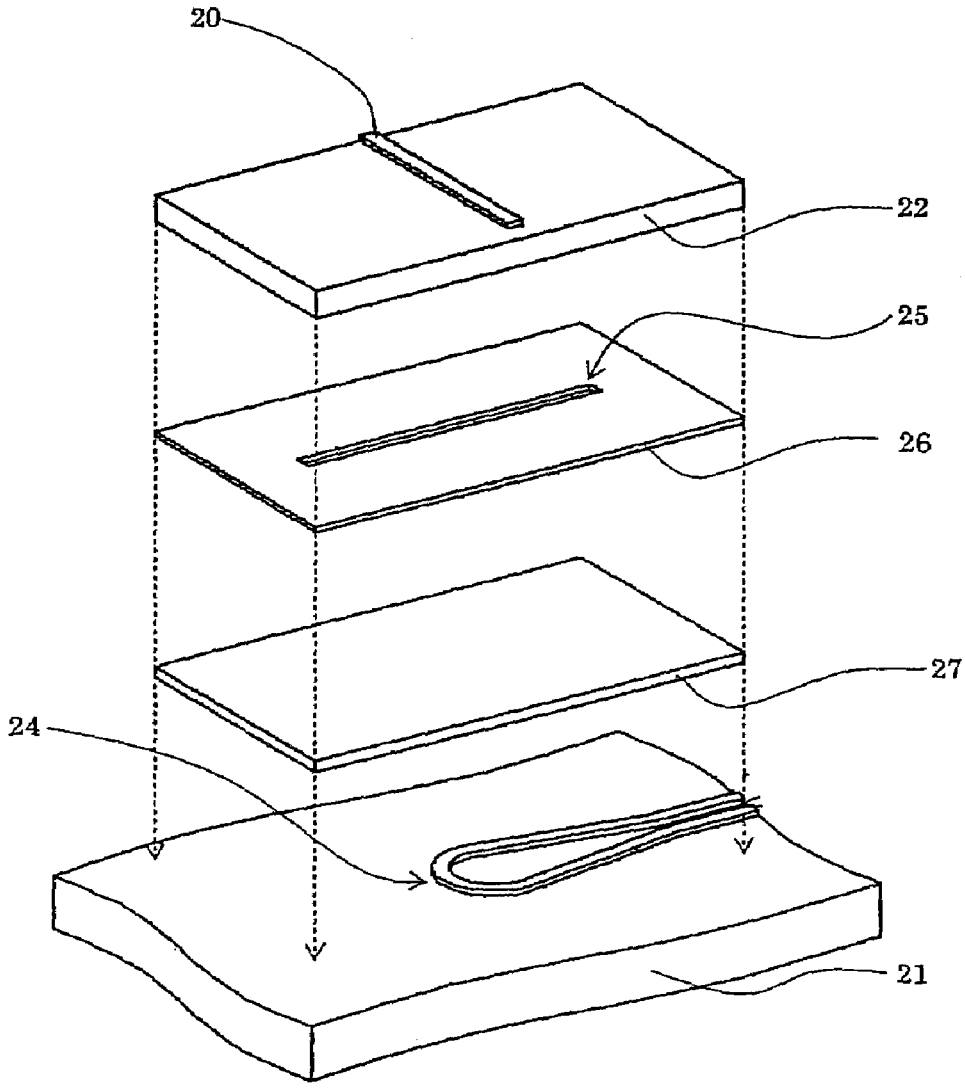
FIG. 6 is a schematic view showing a transmission line transition utilizing a conventional electromagnetically coupling conductor for a coplanar strip transmission line.

On the assumption that a transmission line transition was fabricated just as shown in FIGS. 1, 2, 3 and 4, transmission characteristics from a pair of conductors 3 for a coplanar strip transmission line to an electromagnetically coupling conductor 10 for a microstrip line were calculated by the FDTD method (Finite Difference Time Domain method). The operating frequency were set at 2.34 GHz. The dimensions of respective parts are shown below, and the frequency characteristics of this example is shown in FIG. 5. In FIG. 5, reference numeral 19 designates reflection loss, and reference numeral 18 designates insertion loss.

| | |
|---|---|
| Dimensions or area of second dielectric substrate 2: | 12.25 × 32.0 mm (392.0 $mm^2$) |
| Thickness of second dielectric substrate 2: | 0.8 mm |
| Thickness of dielectric layer 7: | 0.42 mm |
| $\epsilon_1$ | 7.0 |
| $\epsilon_2$ | 4.0 |
| $\epsilon_3$ | 2.0 |
| $L_1$ | 8.0 mm |
| $L_2$ | 4.6 mm |
| $L_3$ | 21.0 mm |
| $L_4$ | 7.0 mm |
| $L_5$ | 28.0 mm |
| $W_1$ | 1.45 mm |
| $W_2$, $W_2'$ | 0.4 mm |
| $W_3$, $W_3'$ | 0.5 mm |
| $W_4$ | 1.0 mm |
| $G_1$ | 0.5 mm |

Example 2

Figure 12:
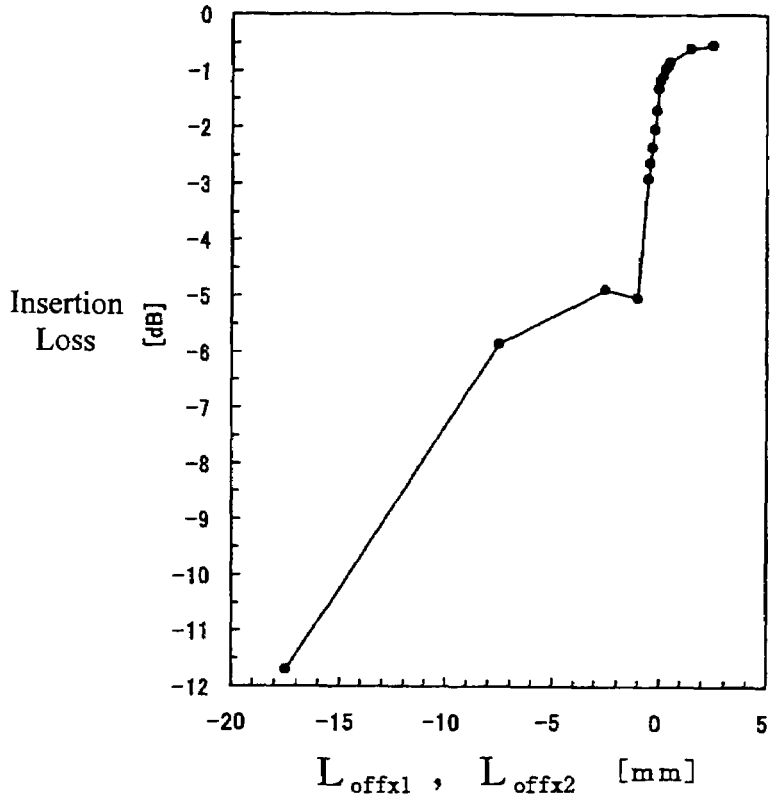
FIG. 12 is a characteristic graph for $L_{offx1}$ or $L_{offx2}$ to insertion loss in Example 2.

On the assumption that a transmission line transition was fabricated so as to be the same as the one in Example 1 except that $L_{offx1}$ and $L_{offx2}$ were modified, transmission characteristics from a pair of conductors 3 for a coplanar strip transmission line to an electromagnetically coupling conductor 10 for a microstrip line were calculated according to the FDTD method. The operating frequency was set at 2.34 GHz. Characteristics of $L_{offx1}$ to insertion loss, which were obtained when the values of $L_{offx1}$ and $L_{offx2}$ were modified, are shown in FIG. 12.

Example 3

Figure 13:
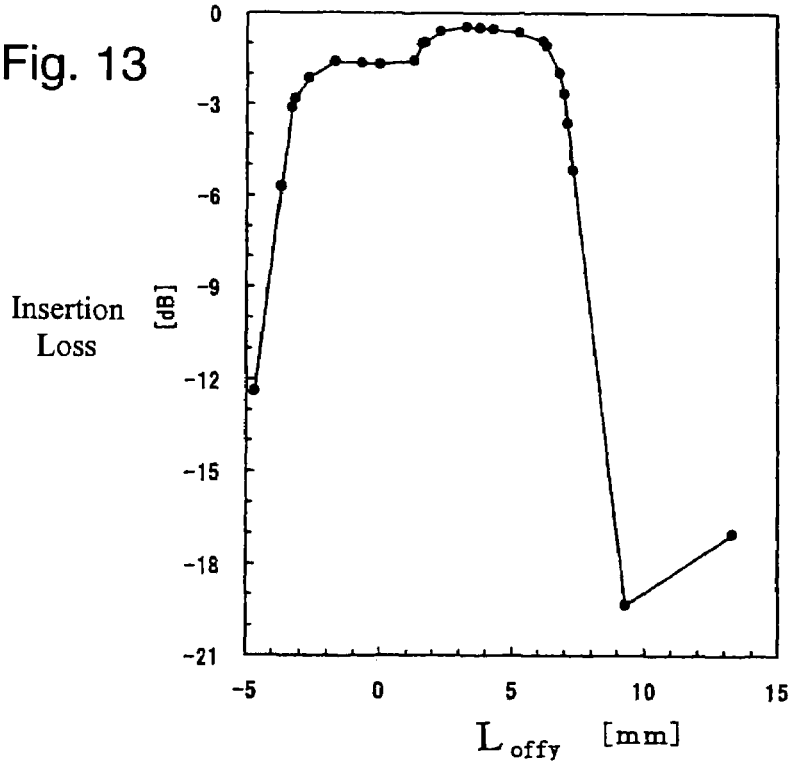
FIG. 13 is a characteristic graph for $L_{offy}$ to insertion loss in Example 3.

On the assumption that a transmission line transition was fabricated so as to be the same as the one in Example 1 except that $L_{offy}$ was modified, transmission characteristics from a pair of conductors 3 for a coplanar strip transmission line to an electromagnetically coupling conductor 10 for a microstrip line were calculated according to the FDTD method. The operating frequency was set at 2.34 GHz. Characteristics of $L_{offy}$ to insertion loss, which were obtained when the value of $L_{offy}$ was modified, are shown in FIG. 13.

Example 4

Figure 14:
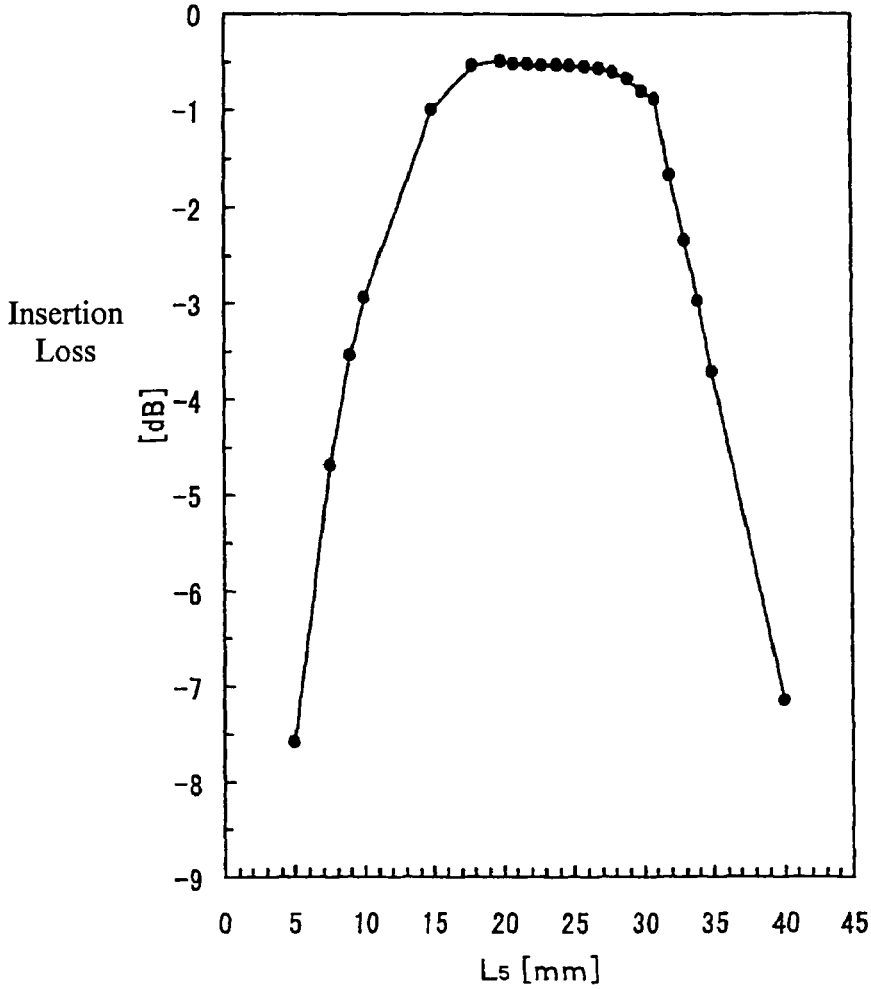
FIG. 14 is a characteristic graph for length $L_5$ to insertion loss in Example 4.

On the assumption that a transmission line transition was fabricated so as to be the same as the one in Example 1 except that the long side width $L_5$ of an electromagnetically coupling conductor 4 for a coplanar strip transmission line was modified, transmission characteristics from a pair of conductors 3 for the coplanar strip transmission line to an electromagnetically coupling conductor 10 for a microstrip line were calculated according to the FDTD method. The operating frequency was set at 2.34 GHz. Characteristics of length $L_5$ to insertion loss, which were obtained when the value of the with $L_5$ was modified, are shown in FIG. 14.

The present invention is applicable to a transmission line transition for a high frequency antenna, which is suitable for use in SDARS, GPS, satellite digital broadcasting, VICS, ETC and DSRC system.

The entire disclosure of Japanese Patent Application No. 2005-73190 filed on Mar. 15, 2005 including specification, claims, drawings and summary is incorporated herein by reference in its entirety.

What is claimed is:

1. A transmission line transition, comprising:

a first dielectric substrate;

a second dielectric substrate spaced from the first dielectric substrate, and a dielectric layer interposed between the first dielectric substrate and the second dielectric substrate, wherein the first dielectric substrate has a pair of conductors for a coplanar strip transmission line and an electromagnetically coupling conductor for the coplanar strip transmission line disposed on a surface of the first dielectric substrate closest to the dielectric layer;

the electromagnetically coupling conductor for the coplanar strip transmission line is a semi-loop shape with a discontinuity partly disposed therein;

respective portions of the electromagnetically coupling conductor for the coplanar strip transmission line, which are located at both ends of the discontinuity or in a vicinity of both ends of the discontinuity, are connected to respective ends of the pair of conductors for the coplanar strip transmission line or portions of the pair of conductors in a vicinity of the respective ends of the pair of conductors, the pair of conductors extending toward a direction to be apart from the electromagnetically coupling conductor, a portion of the electromagnetically coupling conductor for the coplanar strip transmission line located in the vicinity of one of the ends of the discontinuity is perpendicular to a portion of the pair of conductors in the vicinity of one of the ends of the pair of conductors, the portion of the electromagnetically coupling conductor for the coplanar strip transmission line being linearly extended toward a direction to be apart from the pair of conductors for the coplanar strip transmission line;

the semi-loop shape is a rectangular shape or a substantially rectangular shape;

the second dielectric substrate has a grounding conductor disposed on a surface close to the dielectric layer, the grounding conductor having a first slot and a second slot disposed therein so as to be parallel or substantially parallel to each other;

the grounding conductor has a connecting slot disposed therein so as to connect between the first slot and the second slot so that the first slot, the second slot, and the connecting slot form an electromagnetic coupling slot in an H-character shape or substantially H-character shape;

the electromagnetic coupling slot is disposed so that the connecting slot intersects a longitudinal direction of the rectangular shape or the substantially rectangular shape of the semi-loop shape; and the second dielectric substrate has an electromagnetically coupling conductor for a microstrip transmission line disposed on a surface remote from the dielectric layer so as to pass over or under the connecting slot.

2. The transmission line transition according to claim 1, wherein the first dielectric substrate has a thickness of from 2.0 to 6.0 mm and a dielectric constant of from 5.0 to 9.0;

the second dielectric substrate has a thickness of from 0.1 to 6.0 mm and a dielectric constant of from 1.0 to 8.0; and the dielectric layer has a thickness of from 0.1 to 1 .6 mm and a dielectric constant of from 1.0 to 3.0.

3. The transmission line transition according to claim 1, wherein a portion of the electromagnetic coupling slot is disposed so as to overlap with the electromagnetically coupling conductor for the coplanar strip transmission line.

4. The transmission line transition according to claim 1, wherein an imaginary straight line extends in a direction perpendicular to a surface of the first dielectric substrate and passes through a center of the connecting slot, and when the center of the connecting slot is viewed along the imaginary straight line from the surface of the second dielectric substrate, the connecting slot overlaps with a side of the electromagnetically coupling conductor for the coplanar strip transmission line, which is remote from the discontinuity.

5. The transmission line transition according to claim 1, wherein the electromagnetic coupling slot is of such size as to be disposed inside an inner peripheral edge of the electromagnetically coupling conductor for the coplanar strip transmission line;

an imaginary straight line extends in a direction perpendicular to a surface of the first dielectric substrate closest to the dielectric layer and passes through a center of the connecting slot; and when the center of the connecting slot is viewed along the imaginary straight line from the surface of the second dielectric substrate, all portions of the electromagnetic coupling slot are disposed inside the inner peripheral edge of the electromagnetically coupling conductor for the coplanar strip transmission line.

6. The transmission line transition according to claim 1, wherein the connecting slot and the electromagnetically coupling conductor for the microstrip transmission line intersect each other at a right angle or a substantially right angle.

7. The transmission line transition according to claim 1, wherein an imaginary straight line extends in a direction perpendicular to the first dielectric substrate and passes through a center of the connecting slot, and when the center of the connecting slot is viewed along the imaginary straight line from the first dielectric substrate, a point where the connecting slot and the electromagnetically coupling conductor for the microstrip transmission line intersect each other overlaps or substantially overlaps with the center of the connecting slot.

8. The transmission line transition according to claim 1, wherein an imaginary straight line extends in a direction perpendicular to the surface of the first dielectric substrate and passes through a center of the connecting slot; and when the center of the connecting slot is viewed along the imaginary straight line from the surface of the second dielectric substrate, the center of the connecting slot overlaps or substantially overlaps with a side of the electromagnetically coupling conductor for the coplanar strip transmission line, which is remote from the discontinuity.

9. The transmission line transition according to claim 1, wherein an imaginary straight line extends in a direction perpendicular to the surface of the first dielectric substrate and passes through a center of the connecting slot; and when the center of the connecting slot is viewed along the imaginary straight line from the second dielectric substrate, the center of the connecting slot overlaps or substantially overlaps with a center of a side of the electromagnetically coupling conductor for the coplanar strip transmission line, which is remote from the discontinuity.

10. The transmission line transition according to claim 1, wherein the pair of conductors for the coplanar strip transmission line has a narrower conductor width than the electromagnetically coupling conductor for the coplanar strip transmission line.

11. The transmission line transition according to claim 10, wherein a conductor width of the pair of conductors for the coplanar strip transmission line $\leqq 0.6 \times$ a conductor width of the electromagnetically coupling conductor for the coplanar strip transmission line.

12. The transmission line transition according to claim 1, wherein the electromagnetically coupling conductor for the coplanar strip transmission line has a conductor width;

the electromagnetically coupling conductor for the coplanar strip transmission line is continuous except for the discontinuity; and the electromagnetically coupling conductor for the coplanar strip transmission line has an outer peripheral edge and an inner peripheral edge disposed in a square shape or substantially square shape, respectively.

13. The transmission line transition according to claim 12, wherein respective four apexes of four corners of the square shape or the substantially square shape defined by the outer peripheral edge are outer peripheral apexes;

respective four apexes of the four corners of the square shape or the substantially square shape defined by the inner peripheral edge are inner peripheral apexes;

a first imaginary straight line connects between one of the outer peripheral apexes and an inner peripheral apex closest to the one of the outer peripheral apexes;

a second imaginary straight line extends orthogonally or substantially orthogonally to the first imaginary straight line and passes through a center or a position in a vicinity of the center between the one of the outer peripheral apexes and the inner peripheral apex; and a portion of the electromagnetically coupling conductor for the coplanar strip transmission line, which is located outside the second imaginary straight line, is cut out.

14. The transmission line transition according to claim 12, wherein the pair of conductors for the coplanar strip transmission line comprises a first conductor for the coplanar strip transmission line;

an outer peripheral edge of a portion of the electromagnetically coupling conductor for the coplanar strip transmission line, which is close to the first conductor for the coplanar strip transmission line and forms one of both end portions of the electromagnetically coupling conductor for the coplanar strip transmission line at both ends of the discontinuity, is linearly extended toward a central portion of the discontinuity;

a point where the extended outer peripheral edge intersects an inner peripheral edge of the first conductor for the coplanar strip transmission line is a first intersection;

an outer peripheral edge of the first conductor for the coplanar strip transmission line is linearly extended toward a central portion of the electromagnetically coupling conductor for the coplanar strip transmission line;

a point where the extended outer peripheral edge of the first conductor intersects an inner peripheral edge of the electromagnetically coupling conductor for the coplanar strip transmission line is a second intersection;

an imaginary straight line connects between the first intersection and the second intersection; and a portion of the electromagnetically coupling conductor for the coplanar strip transmission line or of the first conductor for the coplanar strip transmission line, the portion being closer to the central portion of the electromagnetically coupling conductor for the coplanar strip transmission line than the imaginary straight line, is cut out.

15. The transmission line transition according to claim 12, wherein the pair of conductors for the coplanar strip transmission line comprises a first conductor for the coplanar strip transmission line and a second conductor for the coplanar strip transmission line;

an outer peripheral edge of a portion of the electromagnetically coupling conductor for the coplanar strip transmission line, which is close to the second conductor for the coplanar strip transmission line and forms one of both end portions of the electromagnetically coupling conductor for the coplanar strip transmission line at both ends of the discontinuity, is linearly extended toward a central portion of the discontinuity;

a point where the extended outer peripheral edge intersects an inner peripheral edge of the second conductor for the coplanar strip transmission line is a first intersection;

an outer peripheral edge of the second conductor for the coplanar strip transmission line is linearly extended toward a central portion of the electromagnetically coupling conductor for the coplanar strip transmission line;

a point where the extended outer peripheral edge of the second conductor intersects an inner peripheral edge of the electromagnetically coupling conductor for the coplanar strip transmission line is a second intersection;

an imaginary straight line connects between the first intersection and the second intersection; and a portion of the electromagnetically coupling conductor for the coplanar strip transmission line or of the second conductor for the coplanar strip transmission line, the portion being closer to the central portion of the electromagnetically coupling conductor for the coplanar strip transmission line than the imaginary straight line, is cut out.

16. The transmission line transition according to claim 1, wherein the transmission line transition has an operating frequency of from 1.95 to 2.93 GHz; and the electromagnetically coupling conductor for the coplanar strip transmission line has a side opposite the discontinuity, the side having a length $L_5$ of from 5.0 to 46.1 mm.

17. The transmission line transition according to claim 16, wherein the electromagnetically coupling conductor for the coplanar strip transmission line has two sides adjacent the side opposite the discontinuity, the two sides each having a length $L_4$ of from 5.0 to 46.1 mm.

18. The transmission line transition according to claim 17, wherein $$1.1 \times \text{length } L_4 \leqq \text{length } L_5.$$

19. The transmission line transition according to claim 1, wherein the transmission line transition has an operating frequency of from 1.95 to 2.93 GHz;

the pair of conductors for the coplanar strip transmission line comprises a first conductor for the coplanar strip transmission line and a second conductor for the coplanar strip transmission line;

the first conductor for the coplanar strip transmission line and the second conductor for the coplanar strip transmission line have a gap for the coplanar strip transmission line interposed therebetween;

an imaginary straight line passes through a center of the gap for the coplanar strip transmission line and extends toward a center of the electromagnetically coupling conductor for the coplanar strip transmission line;

the electromagnetically coupling conductor for the coplanar strip transmission line is divided into a portion close to the first conductor for the coplanar strip transmission line and a portion close to the second conductor for the coplanar strip transmission line, by the imaginary straight line;

an inner edge of a side of the electromagnetically coupling conductor for the coplanar strip transmission line, which forms one of two sides adjacent a side opposite the discontinuity and is close to the first conductor for the coplanar strip transmission line, is a first inner edge;

an inner edge of a side of the electromagnetically coupling conductor for the coplanar strip transmission line, which forms an other one of the two sides adjacent the side opposite the discontinuity and is close to the second conductor for the coplanar strip transmission line, is a second inner edge;

a leading edge of the first slot, which is close to the first inner edge, is a first leading edge of the first slot;

a leading edge of the first slot, which is close to the second inner edge, is a second leading edge of the first slot;

a leading edge of the second slot, which is close to the first inner edge, is a first leading edge of the second slot;

a leading edge of the second slot, which is close to the second inner edge, is a second leading edge of the second slot;

a shorter one of a shortest distance between the first leading edge of the first slot and the first inner edge, and a shortest distance between the first leading edge of the second slot and the first inner edge, is $L_{offx1}$;

a shorter one of a shortest distance between the second leading edge of the first slot and the second inner edge, and a shortest distance between the second leading edge of the second slot and the second inner edge, is $L_{offx2}$;

$$L_{offx1} \geqq -2 \text{ mm, and } L_{offx2} \geqq -2 \text{ mm};$$

a value of $L_{offx1}$ is positive when the first leading edge of the first slot approaches toward the center of the electromagnetically coupling conductor for the coplanar strip transmission line in a direction which is parallel to a longitudinal direction of the side of the electromagnetically coupling conductor for the coplanar strip transmission line remote from the discontinuity, and the value of $L_{offx1}$ is negative when the first leading edge of the first slot is disposed beyond the first inner edge relative to the second inner edge; and a value of $L_{offx2}$ is positive when the second leading edge of the first slot approaches toward the center of the electromagnetically coupling conductor for the coplanar strip transmission line in a second direction which is parallel to the longitudinal direction of the side of the electromagnetically coupling conductor for the coplanar strip transmission line remote from the discontinuity, and the value of $L_{offx2}$ is negative when the second leading edge of the first slot is disposed beyond the second inner edge relative to the first inner edge.

20. The transmission line transition according to claim 1, wherein the electromagnetically coupling conductor for the coplanar strip transmission line has a short side and a long side;

the short side has a length $L_4$;

the long side has a length $L_5$; and $$0.11 \leqq (L_4/L_5) < 1.0.$$

21. The transmission line transition according to claim 1, wherein a distance between an outer edge of a side of the electromagnetically coupling conductor for the coplanar strip transmission line close to the pair of conductors for the coplanar strip transmission line and an edge of the first slot close to the connecting slot is $L_{offy}$;

$$-4.3 \text{ mm} \leqq L_{offy} \leqq 8.0 \text{ mm; and}$$

a value of $L_{offy}$ is positive when the edge of the first slot close to the connecting slot is disposed so as to be close to a side of the electromagnetically coupling conductor for the coplanar strip transmission line remote from the discontinuity with the outer edge of the side of the electromagnetically coupling conductor for the coplanar strip transmission line close to the pair of conductors for the coplanar strip transmission line used as a boundary, and the value of $L_{offy}$ is negative when the edge of the first slot is disposed beyond the outer edge relative to the side remote from the discontinuity.

22. A transmission line transition, comprising:

a first dielectric substrate;

a second dielectric substrate spaced from the first dielectric substrate, and a dielectric layer interposed between the first dielectric substrate and the second dielectric substrate, wherein the first dielectric substrate has a pair of conductors for a coplanar strip transmission line and an electromagnetically coupling conductor for the coplanar strip transmission line disposed on a surface of the first dielectric substrate closest to the dielectric layer;

the electromagnetically coupling conductor for the coplanar strip transmission line is a semi-loop shape with a discontinuity partly disposed therein;

respective portions of the electromagnetically coupling conductor for the coplanar strip transmission line, which are located at both ends of the discontinuity or in a vicinity of both ends of the discontinuity, are connected to respective ends of the pair of conductors for the coplanar strip transmission line or portions of the pair of conductors in a vicinity of the respective ends of the pair of conductors, the pair of conductors extending toward a direction to be apart from the electromagnetically coupling conductor, a portion of the electromagnetically coupling conductor for the coplanar strip transmission line located in the vicinity of one of the ends of the discontinuity is perpendicular to a portion of the pair of conductors in the vicinity of one of the ends of the pair of conductors, the portion of the electromagnetically coupling conductor for the coplanar strip transmission line being linearly extended toward a direction to be apart from the pair of conductors for the coplanar strip transmission line;

the semi-loop shape is a square shape or a substantially square shape;

the second dielectric substrate has a grounding conductor disposed on a surface close to the dielectric layer, the grounding conductor having a first slot and a second slot disposed therein so as to be parallel or substantially parallel to each other;

the grounding conductor has a connecting slot disposed therein so as to connect between the first slot and the second slot so that the first slot, the second slot, and the connecting slot form an electromagnetic coupling slot in an H-character shape or substantially H-character shape;

the electromagnetic coupling slot is disposed so that a portion of the connecting slot extending in a longitudinal direction passes over or under a side of the electromagnetically coupling conductor for the coplanar strip transmission line remote from the discontinuity; and the second dielectric substrate has an electromagnetically coupling conductor for a microstrip transmission line disposed on a surface remote from the dielectric layer so as to pass over or under the connecting slot.

23. The transmission line transition according to claim 22, wherein the transmission line transition has an operating frequency of from 1.95 to 2.93 GHz;

the pair of conductors for the coplanar strip transmission line comprises a first conductor for the coplanar strip transmission line and a second conductor for the coplanar strip transmission line;

the first conductor for the coplanar strip transmission line and the second conductor for the coplanar strip transmission line have a gap for the coplanar strip transmission line interposed therebetween;

an imaginary straight line passes through a center of the gap for the coplanar strip transmission line and extends toward a center of the electromagnetically coupling conductor for the coplanar strip transmission line;

the electromagnetically coupling conductor for the coplanar strip transmission line is divided into a portion close to the first conductor for the coplanar strip transmission line and a portion close to the second conductor for the coplanar strip transmission line, by the imaginary straight line;

an inner edge of a side of the electromagnetically coupling conductor for the coplanar strip transmission line, which forms one of two sides adjacent the side opposite the discontinuity and is close to the first conductor for the coplanar strip transmission line, is a first inner edge;

an inner edge of a side of the electromagnetically coupling conductor for the coplanar strip transmission line, which forms an other one of the two sides adjacent the side opposite the discontinuity and is close to the second conductor for the coplanar strip transmission line, is a second inner edge;

a leading edge of the first slot, which is close to the first inner edge, is a first leading edge of the first slot;

a leading edge of the first slot, which is close to the second inner edge, is a second leading edge of the first slot;

a leading edge of the second slot, which is close to the first inner edge, is a first leading edge of the second slot;

a leading edge of the second slot, which is close to the second inner edge, is a second leading edge of the second slot;

a shorter one of a shortest distance between the first leading edge of the first slot and the first inner edge, and a shortest distance between the first leading edge of the second slot and the first inner edge, is $L_{offx1}$;

a shorter one of a shortest distance between the second leading edge of the first slot and the second inner edge, and a shortest distance between the second leading edge of the second slot and the second inner edge; is $L_{offx2}$;

$$L_{offx1} \geqq -2 \text{ mm, and } L_{offx2} \geqq -2 \text{ mm;}$$

a value of $L_{offx1}$ is positive when the first leading edge of the first slot approaches toward the center of the electromagnetically coupling conductor for the coplanar strip transmission line in a direction which is parallel to a longitudinal direction of the side of the electromagnetically coupling conductor for the coplanar strip transmission line remote from the discontinuity, and the value of $L_{offx1}$ is negative when the first leading edge of the first slot is disposed beyond the first inner edge relative to the second inner edge; and a value of $L_{offx2}$ is positive when the second leading edge of the first slot approaches toward the center of the electromagnetically coupling conductor for the coplanar strip transmission line in a second direction which is parallel to the longitudinal direction of the side of the electromagnetically coupling conductor for the coplanar strip transmission line remote from the discontinuity, and the value of $L_{offx2}$ is negative when the second leading edge of the first slot is disposed beyond the second inner edge relative to the first inner edge.

24. The transmission line transition according to claim 22, wherein the electromagnetically coupling conductor for the coplanar strip transmission line has a short side and a long side;

the short side has a length $L_4$;

the long side has a length $L_5$; and $$0.11 \leqq (L_4/L_5) < 1.0.$$

25. The transmission line transition according to claim 22, wherein a distance between an outer edge of a side of the electromagnetically coupling conductor for the coplanar strip transmission line close to the pair of conductors for the coplanar strip transmission line and an edge of the first slot close to the connecting slot is $L_{offy}$;

$$-4.3 \text{ mm} \leqq L_{offy} \leqq 8.0 \text{ mm; and}$$

a value of $L_{offy}$ is positive when the edge of the first slot close to the connecting slot is disposed so as to be close to the side of the electromagnetically coupling conductor for the coplanar strip transmission line remote from the discontinuity with the outer edge of the side of the electromagnetically coupling conductor for the coplanar strip transmission line close to the pair of conductors for the coplanar strip transmission line used as a boundary, and the value of $L_{offy}$ is negative when the edge of the first slot is disposed beyond the outer edge relative to the side remote from the discontinuity

* * * * *